United States Patent [19]

Oxenburg

[11] 4,091,480

[45] May 30, 1978

[54] HOSPITAL MATTRESS WITH REMOVABLE INSERT

[76] Inventor: Samuel Oxenburg, 8838 Danbury St., Philadelphia, Pa. 19152

[21] Appl. No.: 695,364

[22] Filed: Jun. 14, 1976

[51] Int. Cl.[2] ..... A61G 7/04

[52] U.S. Cl. ..... 5/91

[58] Field of Search ..... 5/90, 91

[56] References Cited

U.S. PATENT DOCUMENTS

| | | | |
|---|---|---|---|
| 225,455 | 3/1880 | Adams | 5/90 |
| 557,614 | 4/1896 | Schmitt | 5/90 |
| 1,350,333 | 8/1920 | Erik | 5/90 |
| 1,443,667 | 1/1923 | Zachary | 5/91 |
| 2,116,171 | 5/1938 | Harris | 5/91 |

*Primary Examiner*—Kenneth J. Dorner
*Attorney, Agent, or Firm*—Weiser, Stapler & Spivak

[57] ABSTRACT

A hospital bed mattress including a removable insert which is positioned at one transverse edge of the mattress. The insert is slidable transversely relative to the mattress to expose a cavity into which additional equipment, such as a bed pan can be placed. The insert includes slide construction which is retained in association with the mattress to prevent the insert from falling after it is moved transversely to expose the cavity. The insert also includes a handle which faces in the direction of the patient to permit a bedridden patient to push the insert outwardly to expose the cavity and also, to pull the insert back into its original position to restore the mattress to its original condition.

6 Claims, 4 Drawing Figures

HOSPITAL MATTRESS WITH REMOVABLE INSERT

BACKGROUND OF THE INVENTION

The present invention relates generally to hospital bed mattresses and more particularly, is directed to a hospital bed mattress having a removable insert.

The present invention is specifically designed for use with hospital type beds and is adapted to expose a cavity or service area within the mattress into which a bed pan or other apparatus may be conveniently positioned. In the case of bed-ridden patients, it has been the common practice to employ bed pans to allow the patient to dispose of human waste without the necessity of leaving the bed. In those instances wherein the bed pan is positioned directly upon the top surface of the mattress, the use of the bed pan has proved quite difficult for the patient. When using bed pans, it had been the usual practice in most hospitals to lift the patient as necessary to place the bed pan beneath the patient. This movement in many instances could prove most painful and difficult for the patient. Alternatively, it was possible to roll the patient to one side and then place the bed pan on the mattress in the desired position. With the bed pan thus positioned, the patient was then rolled back onto the bed pan while at the same time lifting the patient as necessary to place him directly upon the bed pan. This procedure also could be painful.

Prior workers in the art have attempted to improve the situation by providing mattresses with removable service plugs to eliminate the above difficulties which had been encountered in the case of surface positioned bed pans. Hospital type mattresses with removable insert portions have previously been disclosed in U.S. Pat. No. 3,833,945, 3,623,170 and 1,350,333. These prior art devices have not been completely successful or practical for any one of several reasons. Some of the prior art mattresses required special sheets, the cost of which would place the use of such mattresses out of the economically feasible range of most hospitals. Other of the prior art devices could be installed only on one side of the mattress, thereby necessitating either right hand or left hand inventory for use with certain patients who could use only one hand. Other devices were unsatisfactory in that they could not be patient operated, but rather, had to be functioned by an attendant. In the case of such devices, the attendant was not always readily available. Further, the mattress requiring attendant operation would therefore prevent the attendant from attending to other duties. Other disadvantages involved the lack of patient comfort as well as the impracticality of use.

SUMMARY OF THE INVENTION

The present invention relates generally to a hospital bed mattress with removable insert and more particularly, is directed to a removable insert that may be entirely patient operated without the need for outside aid.

The present invention remedies and overcomes all of the deficiencies and disadvantages of the prior art hospital bed mattress and insert combinations and provides a novel hospital bed mattress having a removable insert portion designed for patient operation under all conditions of use.

The present invention includes a mattress provided with a service cavity positioned at one transverse end and which is preferably arranged near the transverse axis of the mattress. A removable insert of configuration to substantially close the cavity is a sliding fit within the cavity and is designed for patient operation without the need for outside assistance. The insert includes a handle facing the patient, which handle can be grasped by the patient to either push the insert outwardly to expose the cavity or else to pull the insert inwardly to fill the cavity. Sliding means are provided in the insert or the mattress or partly in each to facilitate horizontal sliding engagement between the insert and the mattress. The sliding means are so arranged as to prevent disassociation of the insert from the mattress either when the insert is pushed outwardly to expose the mattress cavity or when the insert is pulled inwardly to substantially fill the cavity. By maintaining the association between the insert and the mattress at all times, there is no chance that the insert can fall to the floor or become otherwise unavailable to prohibit use by the patient when so desired.

A lock which may be a spring actuated clip secures the insert to the mattress in an easily unlockable arrangement to prevent the insert from drifting outwardly from the mattress when the cavity is not in use so that the full mattress remains available for patient use.

It is therefore an object of the present invention to provide an improved hospital mattress with removable insert of the type set forth.

It is another object of the present invention to provide a novel hospital mattress with removable insert including means to permit a patient to both push the insert from the mattress to expose a cavity and also to pull the insert inwardly relative to the mattress to fill the cavity.

It is another object of the present invention to provide a novel hospital bed mattress with removable insert wherein the insert comprises a sliding means to permit the insert from the mattress under all conditions of use.

It is another object of the present invention to provide a novel hospital bed with removable insert wherein the insert comprises means to slide the insert relative to the mattress to expose a cavity and wherein the combination mattress and insert can be covered with standard size hospital bed sheets.

It is another object of the present invention to provide a novel hospital bed mattress with removable insert wherein the insert includes handle means to enable the patient to displace the insert to expose a cavity and to replace the insert to fill the cavity without the need for any outside assistance.

It is another object of the present invention to provide a novel hospital bed mattress and removable insert therefore that is inexpensive in manufacture, simple in operation and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views, and in which:

DESCRIPTION OF THE PREFERRED EMBODIMENT OF THE INVENTION

Figure 1:
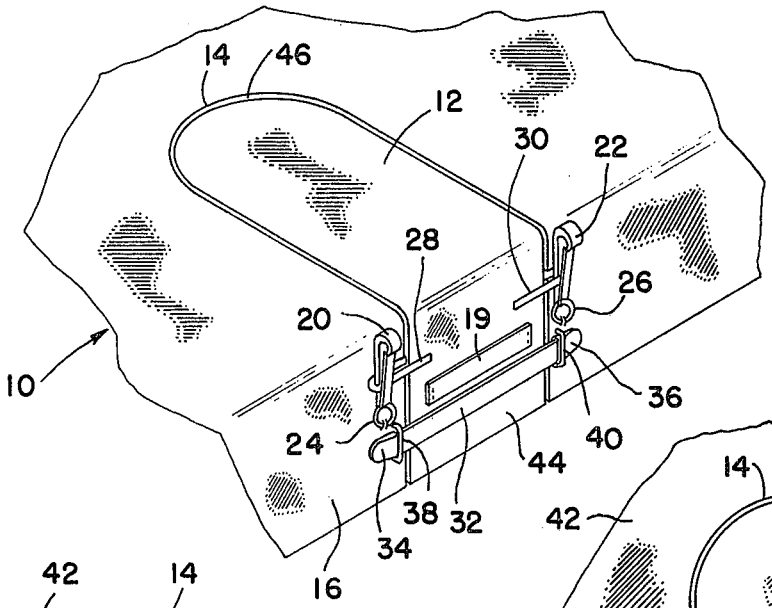
FIG. 1 is an isometric view of the mattress and insert of the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a mattress 10 of the type suitable for use with hospital beds (not illustrated). The mattress 10 is fabricated to define a transverse cavity or slot 14 which is positioned at one transverse edge 16 of the mattress. The cavity 14 is illustrated as being positioned approximately in alignment with the transverse axis of the mattress, but the exact positioning is not critical and the cavity may be moved either upwardly toward the head of the mattress or downwardly toward the foot of the mattress as may be desired. It will be remembered that the purpose of the cavity is for the placement of a bed pan or other apparatus for use by a bedridden patient. Accordingly, the cavity should be positioned where it may be most conveniently used by a bedridden patient. It will be appreciated that inasmuch as the cavity 14 communicates and extends inwardly from one transverse edge 16 of the mattress 10, the same construction can be employed for use at the other transverse edge of the bed simply by rotating the mattress 10 over through one hundred and eighty degrees. Thus, the same mattress construction 10 can be utilized either for left hand operation by the patient as shown or also for right hand operation by the patient simply by turning the mattress over. It is contemplated that conventional hospital sheets can be utilized to overfit the mattress 10 and the removable insert 12 in usual manner to thereby not require the expense and special attention of specially constructed bed linens. In this manner, no special handling, laundering, purchasing or other undesirable procedures will be required. If desired, special sheets also could be designed and employed.

The insert 12 is shaped to conform to the configuration of the cavity 14 so that the mattress may be conventionally used without discomfort when the cavity is not exposed. The cavity 14 will be preferably constructed to a configuration suitable to hold easily a bed pan or other apparatus for patient use. The cavity 14 may be configured identical in shape to that illustrated or may be otherwise shaped as may be desirable or necessary to utilize the desired equipment (not shown) such as a bed pan which will be placed within the cavity 14 for patient use.

Figure 2:
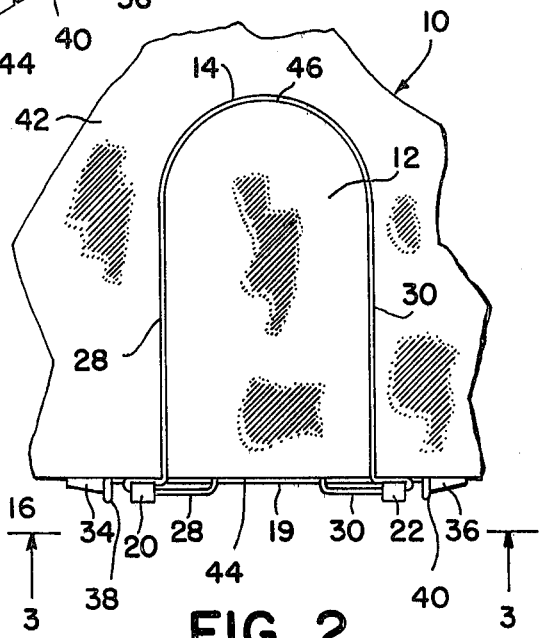
FIG. 2 is a partial, top plan view showing the insert fully seated within the mattress cavity.

The insert 12 is preferably fabricated of the same material as the mattress 10, for example, an expanded, soft, plastic foam material, such as polyurethane foam. A handle 18 projects inwardly from the inward surface of the insert for patient use. By grasping the handle 18, the insert may be pulled inwardly relative to the cavity 14 to the fully seated position as shown in FIG. 2. In this position, the insert 12 substantially aligns with the mattress 10 to form a uniform top surface 42 for patient comfort. The handle 18 is also utilized by the patient to push the insert outwardly from the mattress 10 to completely expose the cavity 14 to the position illustrated in FIG. 4. The handle 18 always remains in proximity to the mattress 10 so that the patient can readily grasp the insert without great movement or exertion. It is an important object of this invention that the insert 12 always remains in association with the mattress 10 so that the patient never has to leave his bed in order to function the insert 12.

The insert 12 is provided with sliding means which may be in the form of elastic straps 28, 30 which extend from the front 44 to the rear 46 of the insert to provide a sliding engagement means between the insert 12 and the mattress 10. Insert engaging means which may be in the form of snap clips or rings 20, 22 are affixed to the transverse face 16 of the mattress 10 by suitable connectors 24, 26. If rings (not shown) are employed instead of the snap clips 20, 22, one of the rings should be fabricated of the split hinge type to enable the ring to be easily opened or closed to free it from association with the elastic slide 28 or 30. The insert can be pivoted about the snap clips 20, 22 to fully expose the cavity 14 for reception of a bed pan for cleaning purposes, to facilitate applying bed linens to the mattress 10 or for other maintenance purposes for pushing the insert 12 outwardly of the cavity 14. As the insert is moved relative to the cavity, the elastic straps 28, 30 will freely slide within the snap clips 20, 22.

Figure 4:
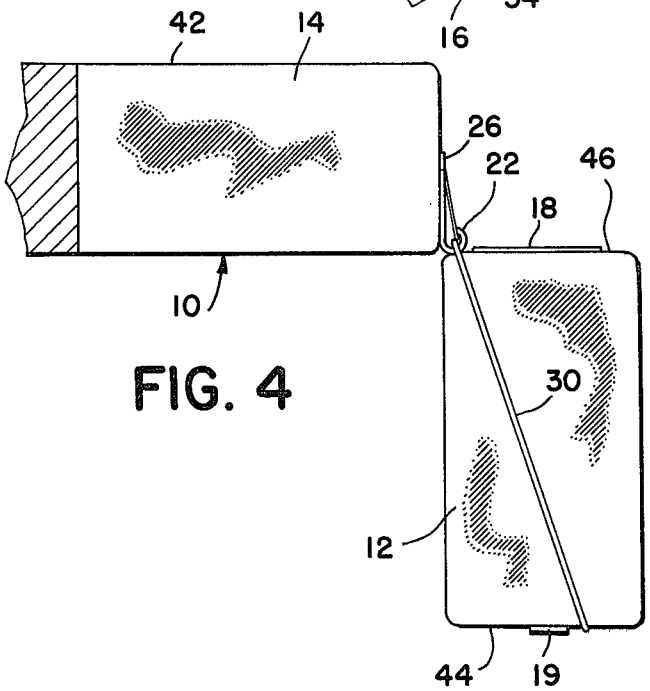
FIG. 4 is a partial, end elevational view showing the insert in its removed position and retained in association with the mattress.

The elastic straps 28, 30 permit the insert 12 to slide outwardly and inwardly relative to the mattress 10 to either expose the cavity when pushed to the outer position of FIG. 4 or to fill the cavity when pulled inwardly to the position illustrated in FIG. 2. Thus, a patient (not shown) can grasp a handle 18 or 19 and urge the insert 12 outwardly causing the elastic straps 28, 30 to slide within the left and right snap clips 20, 22 respectively. When the rear 46 of the insert 12 reaches the transverse edge 16 of the mattress, the weight of the insert will cause its front 42 to pivot downwardly. The snap clips will pivot about their respective connectors 24, 26 and the elastic straps 28, 30 will stretch as necessary. The insert 12 will come approximately to the rest position in association with the mattress 10 in the position illustrated in FIG. 4. The slides 28, 30 should be sufficiently elastic to permit the insert 12 to pivot relative to the mattress 10 when the insert is pushed fully outwardly. The elastic should not be loose enough to allow the insert to drop too far from the mattress top surface 42. Otherwise, the handle 18 will be located too far downwardly to be easily grasped by the bedridden patient.

While the combination of the elastic straps 28, 30 and snap clips 20, 22 have been illustrated for purposes of clarity, it will be appreciated that other slide arrangements, such as various types of slide hardware, may be employed to permit the insert 12 to slide relative to the mattress 10 and to remain in association with the mattress when in the cavity exposing position and still fall within the meaning and intent of this invention.

Figure 3:
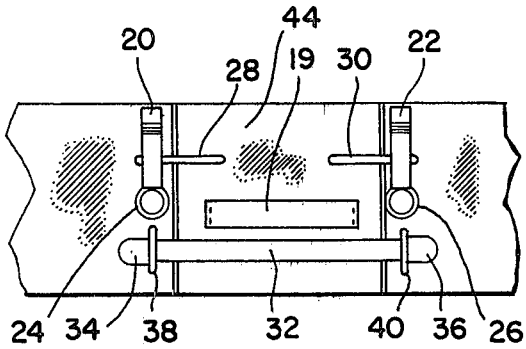
FIG. 3 is a partial, side elevational view looking from Line 3—3 of FIG. 2.

To retain the insert 12 in the cavity filling position as illustrated in FIG. 2 when the device is not in use, a lock strap 32 may be conveniently applied to retain the insert in the desired position. The lock strap 32 is provided at each end with a conventional spring clip 34, 36 to lock to the transverse edge 16 of the mattress. Keepers 38, 40 are affixed to the transverse edge 16 of the mattress 10 in alignment to receive the respective spring clips 34, 36 therethrough. In the position illustrated in FIG. 3, the strap 32 is illustrated in locking position to retain the insert 12 within the cavity 14. When it is desired to push the insert 12 outwardly to expose the cavity 14, either or both of the spring clips 34, 36, for example, the spring clip 36, can be depressed in well known manner to free the clip from the keeper 40. The strap 32 will be retained in association with the mattress 10 at its connected end 34 for future use. The patient (not illustrated) can then push the insert 12 outwardly of the cavity 14 for sliding the elastic straps 28, 30 without their associated respective clips 20, 22. The clips 20, 22 are retained in association with the mattress 10 by the respective connectors 24, 26 and are freely pivotal thereabout to facilitate function with the insert straps 28, 30.

In order to use the invention, the patient (not shown) can reach over the side 16 of the mattress 10 to depress a clip 34 or 36 sufficiently to free the strap from association with a keeper 38 or 40. With the locked insert thus unconnected, the patient can reach down and grasp the handle 18. By pushing on the handle 18, the insert will be directed horizontally, transversely outwardly by sliding the elastic straps 28, 30 within their respective clips 20, 22 a sufficient distance to expose the cavity 14. The elastic straps 28, 30 will then pivot about their connected clips 20, 22 to retain the insert 12 in association with the mattress 10 in a pivoted relationship. See FIG. 4. It will be noted that the rear face 46 of the insert 12 remains in proximity to the mattress top surface 42 to thereby maintain the handle 18 within easy grasping distance of the patient. When it is desired to fill the cavity 14 by utilizing the insert 12, the patient can grasp the handle 18 and pull the insert 12 upwardly and then transversely inwardly until the cavity 14 is completely filled. The insert 12 can be locked in position by threading the spring clip 36 of the lock strap 32 through the mattress mounted keeper 40. See FIG. 3. It will be appreciated that the insert will never be completely free of the mattress and therefore, the insert will always be maintained within easy reach of the patient.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a mattress suitable for support of a patient and adapted for replacement upon a bed frame, said mattress having a top surface, a transverse edge, a cavity communicating with the transverse edge and a removable insert to alternately fill or expose the cavity, the improvement comprising flexible, sliding, engagement means adapted to permit movement of the insert from a first, cavity filling position and thence to a second position to expose the cavity, the entire insert being positioned outwardly from the transverse edge when in the second position, the insert having handle means adapted to return the insert to the first cavity filling position when the handle means is grasped and pulled by the patient, the insert being connected to the mattress by the flexible, sliding, engagement means when in either the cavity filling position or the cavity exposing position, and which is free of connection to the bed frame, wherein the flexible, sliding, engagement means includes at least one elastic strap, at least a portion of said strap is between the insert and the mattress when the insert is in the first position, wherein the strap is adjacent the insert when in the second position and clip means to slidingly secure the strap to the mattress, whereby movement of the insert by the patient without outside help is facilitated.

2. The mattress according to claim 1 and handle means connected to the insert, the said handle means being adapted to be grasped by the patient to either expose the cavity or to fill the cavity, said handle means comprising a pair of spaced handles, said handles being adapted to move the insert transversely relative to the mattress between the said first and second positions.

3. The mattress according to claim 2 wherein one of said handles is positioned to project from the inward surface of the insert in a position to be readily accessible to the patient in the bed when the insert is moved to the second cavity exposing position.

4. The mattress of claim 1 wherein the insert comprises a front face facing away from the mattress and a rear face facing toward the mattress and wherein the strap is secured to both the front face and the rear face whereby the intermediate portion of the strap between the respective insert faces is restrained to retain the insert in sliding engagement with the mattress.

5. The mattress of claim 4 wherein the clip means comprises a clip secured to the mattress near the said transverse edge, the said clip being adaptable to slidingly engage the intermediate portion of the strap to retain the insert always in association with the mattress in both the first and second positions.

6. The mattress of claim 1 wherein the flexible, sliding, engagement means and the clip means are adapted to pivot the insert relative to the mattress when the insert is pushed to the said cavity exposing position.

* * * * *